US009775417B2

(12) United States Patent
De Leon

(10) Patent No.: US 9,775,417 B2
(45) Date of Patent: Oct. 3, 2017

(54) SHOPPING BAG WITH A REUSABLE AND DETACHABLE WRISTLET POUCH

(71) Applicant: Karina De Leon, Vallejo, CA (US)

(72) Inventor: Karina De Leon, Vallejo, CA (US)

( * ) Notice: Subject to any disclaimer, the term of this patent is extended or adjusted under 35 U.S.C. 154(b) by 0 days.

(21) Appl. No.: 14/698,849

(22) Filed: Apr. 29, 2015

(65) Prior Publication Data

US 2016/0318662 A1 Nov. 3, 2016

(51) Int. Cl.

| | |
|---|---|
| ***A45C 15/00*** | (2006.01) |
| ***A45C 3/04*** | (2006.01) |
| ***A45C 7/00*** | (2006.01) |
| *A45F 5/00* | (2006.01) |

(52) U.S. Cl.

CPC ..... *A45C 15/00* (2013.01); *A45C 3/04* (2013.01); *A45C 7/0077* (2013.01); *A45F 2005/008* (2013.01)

(58) Field of Classification Search

CPC ..... A45C 15/00; A45C 3/04; A45C 7/0077; A45F 2005/008

USPC ..... 383/2

See application file for complete search history.

(56) References Cited

U.S. PATENT DOCUMENTS

| | | | | | |
|---|---|---|---|---|---|
| 4,192,365 | A | 3/1980 | Siegel | | |
| 4,995,436 | A * | 2/1991 | Cantor | A45C 1/00 | 150/102 |
| 5,197,525 | A * | 3/1993 | Cantor | A45C 1/00 | 150/102 |
| 5,297,872 | A | 3/1994 | Caligiuri | | |
| 5,472,280 | A | 12/1995 | Rittmaster | | |
| 5,490,619 | A * | 2/1996 | Boyar | A45F 3/02 | 150/103 |
| 5,829,502 | A * | 11/1998 | Distefano | A45C 3/00 | 150/113 |
| 5,894,975 | A * | 4/1999 | Holden | A45C 1/024 | 150/101 |
| 6,230,952 | B1 * | 5/2001 | Jupiter | A45F 3/04 | 150/113 |
| 6,446,688 | B1 * | 9/2002 | Sutton | A45C 3/08 | 150/105 |
| 7,059,371 | B2 * | 6/2006 | Renn | A45C 3/06 | 150/101 |
| 7,958,920 | B1 | 6/2011 | Olsson | | |
| 8,251,113 | B2 * | 8/2012 | Baxter | A45C 1/024 | 150/103 |
| 9,049,910 | B1 * | 6/2015 | Bakali | A45C 13/02 | |

(Continued)

*Primary Examiner* — Peter Helvey

(74) *Attorney, Agent, or Firm* — Law Office of Michael O'Brien

(57) ABSTRACT

The present invention relates to designing a shopping bag that enhances the consumer's experience while shopping. The shopping bag can be folded and fastened using a pair of buttons and bungee bands. Further, the shopping bag can be attached with a reusable wristlet pouch that can store shopping related items such as cards, coupons, cash, wallet or the like. The consumer can either use the shopping bag along with the wristlet pouch or the wristlet pouch individually. Further, the size of the wristlet pouch or the shopping bag can be altered as required by folding the pouch or the shopping bag to the required size and fastening the folded pouch or the shopping bag by using a plurality of buttons and bungee band. Further, the shopping bag and/or the wristlet pouch can be carried by using the handles provided on the shopping bag/wristlet pouch.

7 Claims, 18 Drawing Sheets

(56) References Cited

U.S. PATENT DOCUMENTS

| | | | | |
|---|---|---|---|---|
| 9,226,557 | B2 * | 1/2016 | Sullivan | A45C 3/001 |
| 2002/0121322 | A1 * | 9/2002 | Seamon | A45C 1/024<br>150/113 |
| 2003/0128897 | A1 * | 7/2003 | Lehrman | A45C 13/1046<br>383/2 |
| 2006/0062493 | A1 * | 3/2006 | Chu | A45C 7/0068<br>383/2 |
| 2006/0198562 | A1 * | 9/2006 | Mogil | A45C 7/0077<br>383/121.1 |
| 2008/0037907 | A1 * | 2/2008 | Suskind | B65D 33/06<br>383/2 |
| 2009/0084475 | A1 * | 4/2009 | Dean-Perry | A45C 3/08<br>150/107 |
| 2010/0084443 | A1 | 4/2010 | Adelman | |
| 2010/0104223 | A1 | 4/2010 | Hickey et al. | |
| 2011/0142373 | A1 | 6/2011 | Kong | |
| 2012/0057809 | A1 * | 3/2012 | Buller | A45C 7/0077<br>383/2 |
| 2012/0087601 | A1 | 4/2012 | Nathan et al. | |
| 2014/0053960 | A1 * | 2/2014 | Johnson | A45C 3/06<br>150/113 |

* cited by examiner

SHOPPING BAG WITH A REUSABLE AND DETACHABLE WRISTLET POUCH

FIELD OF THE INVENTION

The present invention generally relates to a designing a shopping bag with a reusable and detachable wristlet pouch and more particularly relates to designing a shopping bag that enhances the customer's shopping experience by providing a reusable and detachable wristlet pouch for placing various shopping related items while the customer is shopping.

BACKGROUND OF THE INVENTION

There are various types of reusable, detachable shopping bag with companion pouches available in the market with varying colors and sizes. The fastening/securing of pouch to the bag differs and also the means of folding, carrying the bag varies from one to another. However, the means and ways of attaching the wristlet pouch to the shopping bag and folding the bag conveniently by fastening using a commonly available means is lacking. Further, at times it becomes an overhead for the customers to carry the shopping bag along with them while shopping.

Accordingly, there exists a need for a shopping bag that can be folded and fastened conveniently along with a reusable and detachable wristlet pouch, which can enhance the shopping experience of a customer. Further, there is a need for the customers to have a hand free shopping experience.

SUMMARY OF THE INVENTION

The present invention relates to designing a shopping bag with a reusable and detachable wristlet pouch that enhances a customer's shopping experience. The shopping bag comprises of a main body, a handle attached on either side of the main body, a vertical fold provided on either side of the main body for folding the main body, a plurality of buttons placed one on each side of the main body that can be folded along the vertical fold, a means to fasten the plurality of buttons placed on each side of the vertical fold of the main body, a means to compress and expand the size of the main body, and a means to attach a wristlet pouch on the front side of the shopping bag. The customer can use the reusable and detachable wristlet pouch, without the shopping bag, to place items such as coupons, cash, wallet or the like to make the shopping easier for the customer and to provide hands free shopping experience for the customer while involved in a shopping activity.

FIGURE DESCRIPTION

100—A shopping bag
101—Main body of the shopping bag
102—A reusable and detachable wristlet pouch
103—Handle connected to the wristlet pouch
104—A plurality of handles attached to the main body of the shopping bag
105—Vertical folds provided on the shopping bag
201—A plurality of buttons provided on the main body
202—A bungee band used to fasten the plurality of buttons
203—The main body folded along the vertical folds
301—A plurality of snap buttons
701—Bottom flap provided at the bottom of the main body
702—Center fold provided on the main body
703—Plurality of vertical folds provided on the main body
1101—hook and loop fastener strips provided at the four corners
1201—Front side of the wristlet pouch
1202—Back side of the wristlet pouch
1301—hook and loop fastener strips attached at the back side of the wristlet pouch
1501—A plurality of wheels attached to the shopping bag
1601—A retractable plurality of wheels attached to the shopping bag

DETAILED DESCRIPTION OF THE INVENTION

The following detailed description of the preferred embodiments presents a description of certain specific embodiments to assist in understanding the claims. However, the present invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details.

Figure 1:
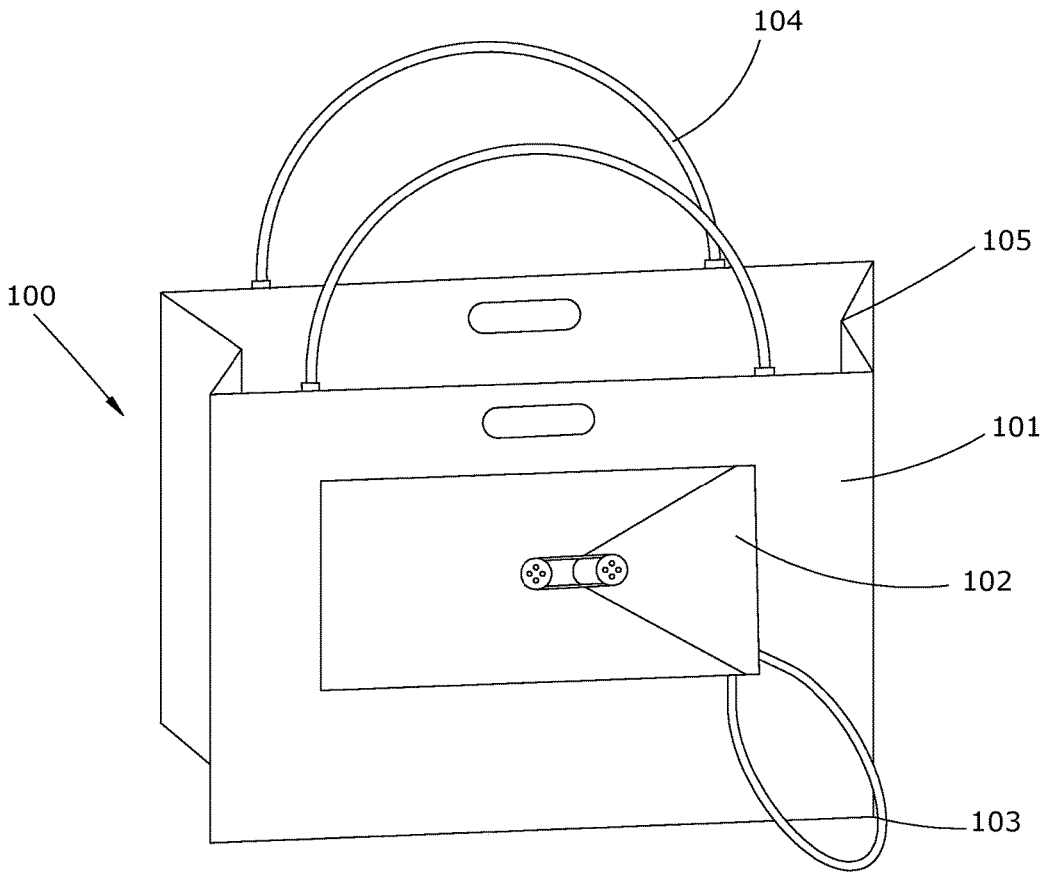
FIG. 1 illustrates a front view of the shopping bag.

Referring to FIG. 1, illustrates a front view of the shopping bag 100. In an embodiment, the shopping bag 100 comprises of a main body with a plurality of handles 104 fitted on either side of the main body 101 and the front side of the main body 101 is attached with a reusable and detachable wristlet pouch 102. The shopping bag 100 can be folded along the vertical folds 105 provided at either side of the shopping bag 100. By folding the main body 101 along the vertical folds 105, the size of the shopping bag 100 can be altered. In an embodiment, the wristlet pouch 102 is provided with a small handle 103 to carry the pouch individually without the need to carry the shopping bag 100. In an embodiment, the wristlet pouch 102 can be used to carry coupons, wallet, cash and any other shopping related items while the customer is shopping. After completing the shopping activity, the wristlet pouch 102 can be reattached to the shopping bag 100.

Figure 2:
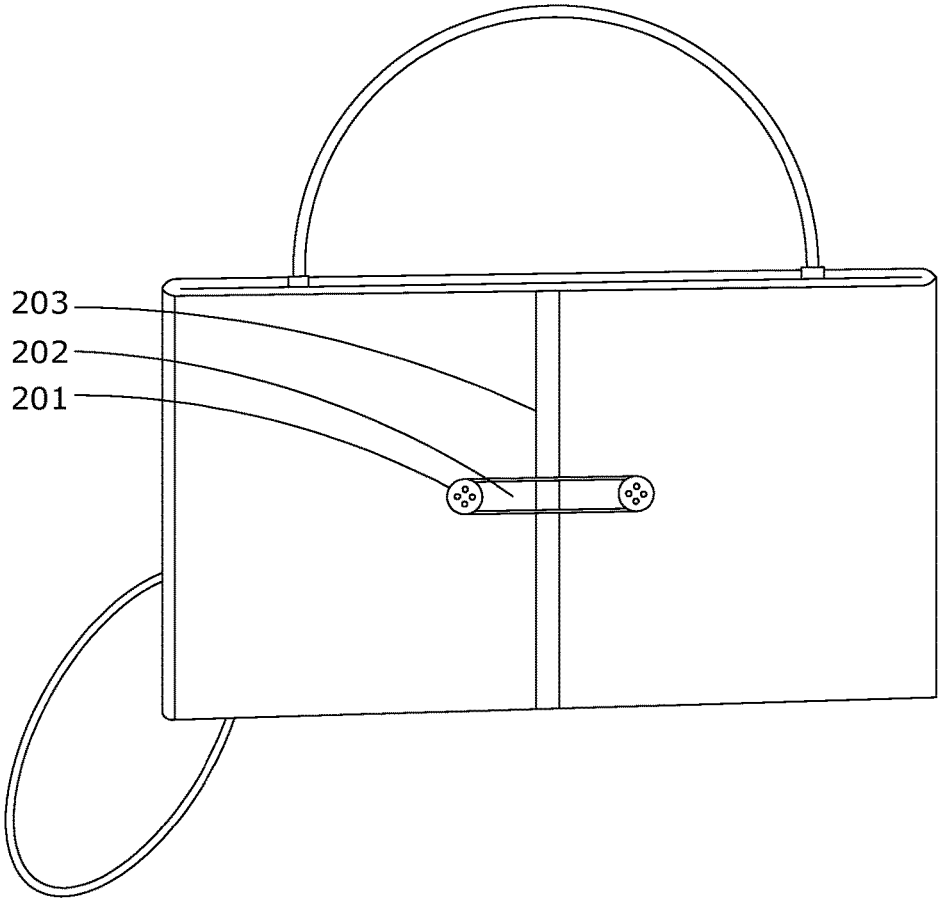
FIG. 2 illustrates a back view of the shopping bag.

Referring to FIG. 2, illustrates a back view of the shopping bag 100. In an embodiment, the main body of the shopping bag 100 is folded towards the back side of the bag 100 along the vertical folds 105. In an embodiment, each of the folded sides 203 of the bag 100 are fitted with buttons 201 that are fastened using a bungee band 202.

Figure 3:
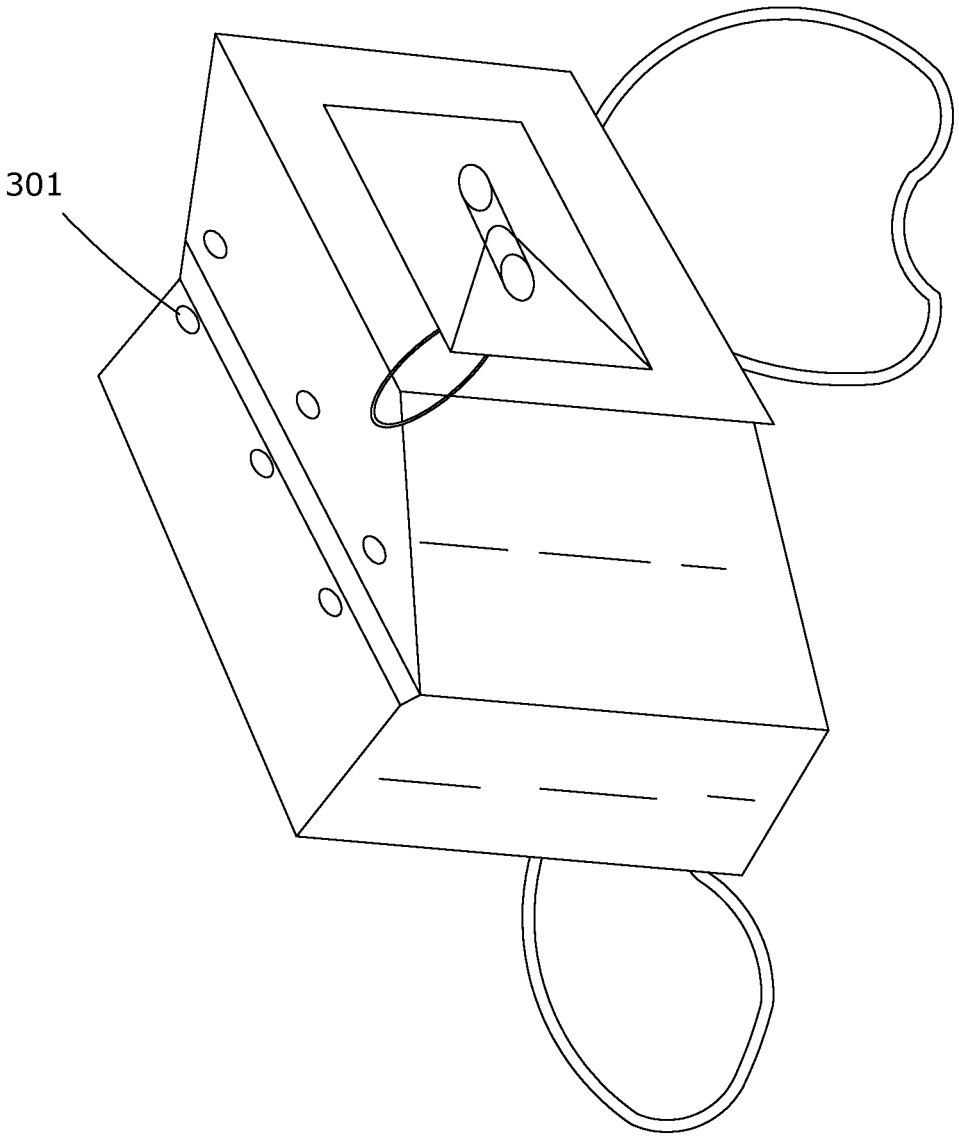
FIG. 3 illustrates a side view of the snap buttons provided at the bottom of the shopping bag.

Referring to FIG. 3, illustrates a side view of the snap buttons 301 provided at the bottom of the shopping bag 100. In an embodiment, the snap buttons 301 are used to compress or expand the main body 101 of the shopping bag 100. As the snap buttons 301 are fastened, the main body 101 of the shopping bag 100 is compressed, and as the snap buttons 301 are released, the main body 101 of the shopping bag expands. Based on the customer's requirement, the shopping bag 100 can be either compressed or expanded. As depicted in the figure, a single layer snap buttons 301 are provided at the bottom center of the main body 101. When the single layered snap buttons 301 are fastened, the width of the main body 101 decreases. Further, as the single layered snap buttons 301 are released the width of the main body 101 expands.

Figure 4:
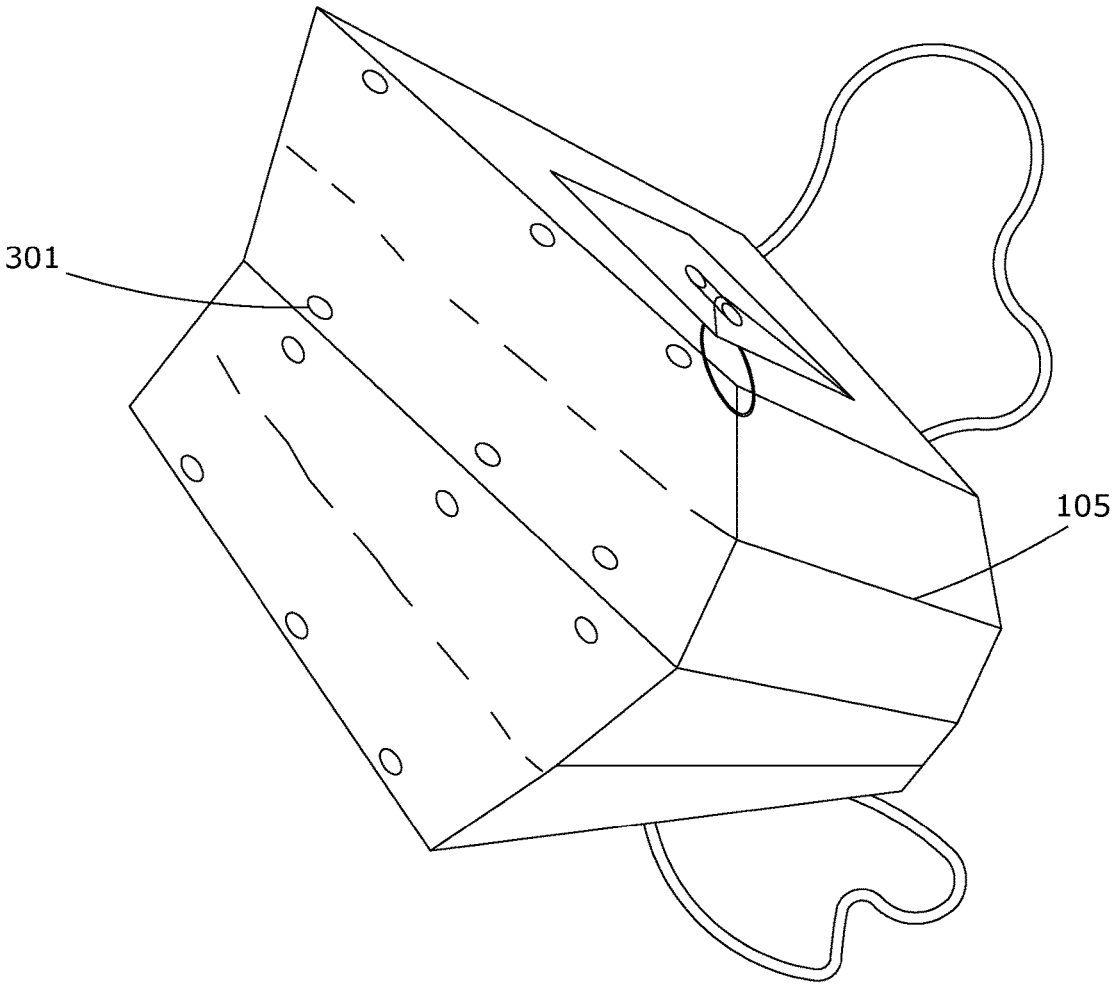
FIG. 4 illustrates a bottom view of the snap buttons provided at the bottom of the shopping bag.

Referring to FIG. 4, illustrates a bottom view of the snap buttons 301 provided at the bottom of the shopping bag 100 for expanding or compressing the size of the shopping bag 100. As depicted in the figure, a double layered snap buttons 301 are provided at the bottom of the shopping bag 100. When the double layered snap buttons 301 are fastened, the size of the main body 101 of the shopping bag 100 gets compressed, and as the snap buttons 301 are released, the size of the main body 101 of the shopping bag 100 gets expanded.

Figure 5:
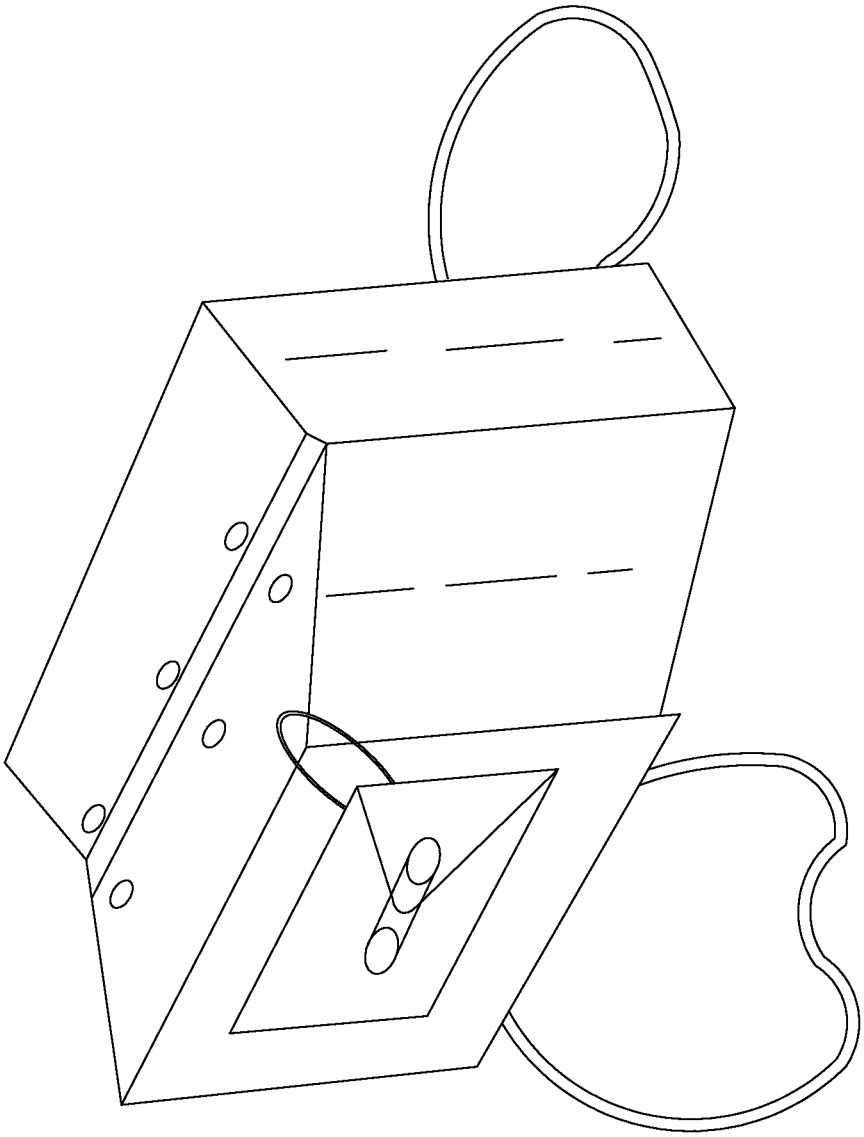
FIGS. 5, 6 illustrate different views of the snap buttons provided at the bottom of the shopping bag.
Figure 6:
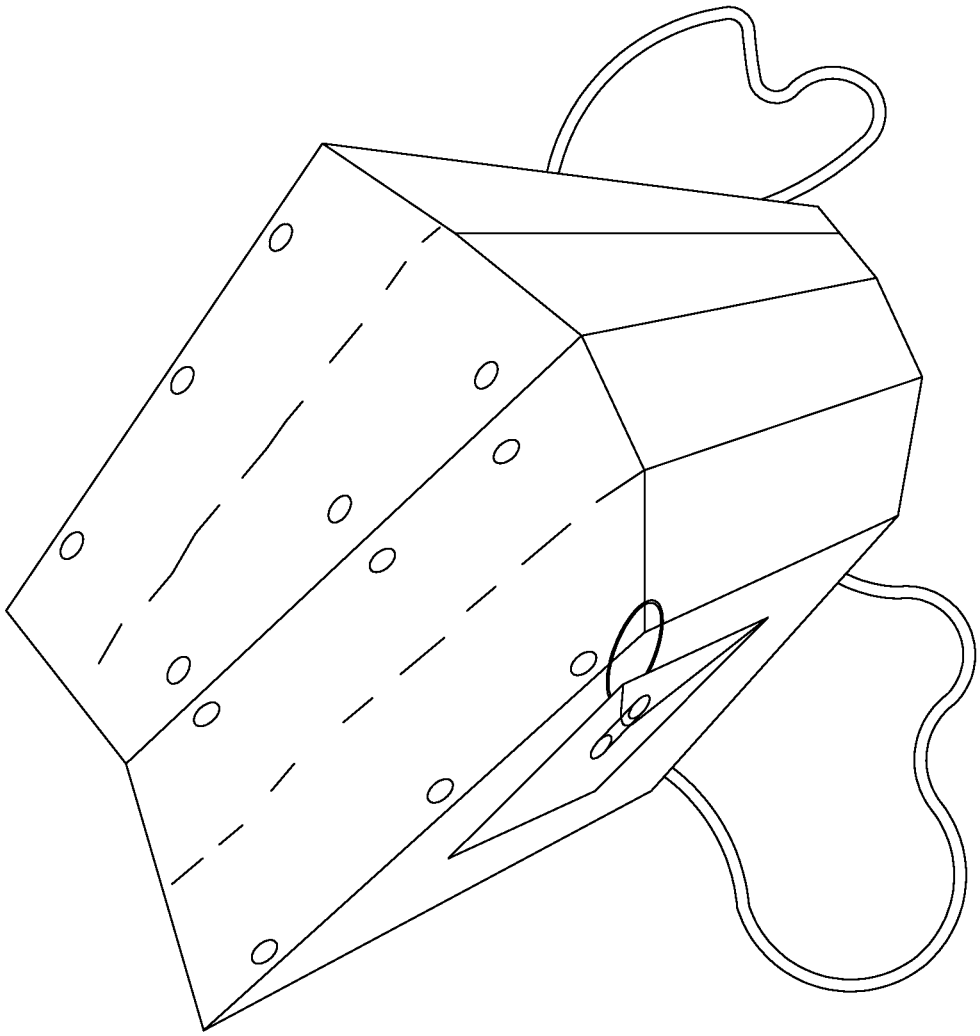

Referring to FIGS. 5 and 6, illustrate different views of the snap buttons 301 provided at the bottom of the shopping bag 100.

Figure 7:
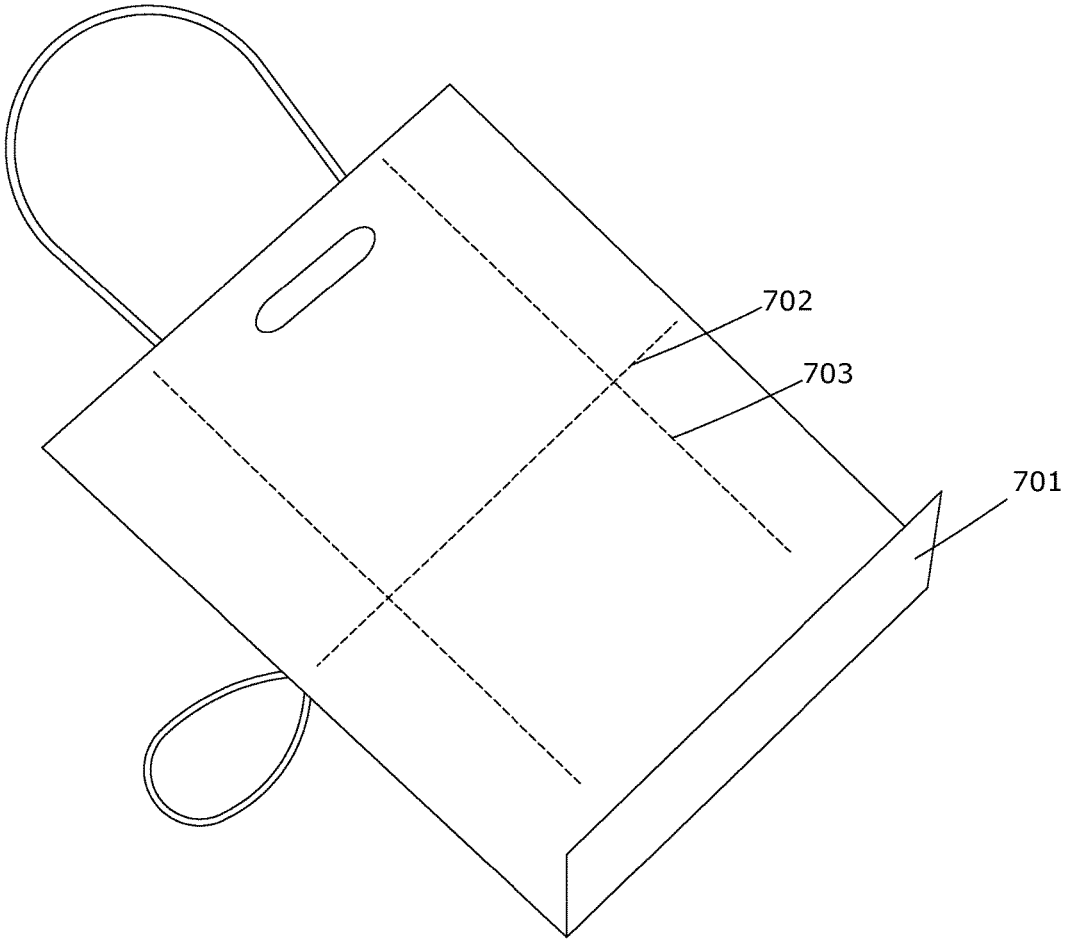
FIG. 7 illustrates the shopping bag folded at the bottom portion.

Referring to FIG. 7, illustrates the shopping bag 100 folded at the bottom portion. In an embodiment, the bottom flap 701 provided at the bottom portion of the shopping bag 100 can be folded to reduce the size of shopping bag 100. In an embodiment, the shopping bag 100 is provided with two vertical folding 703 towards the sides of shopping bag 100 to fold the sides of the shopping bag 100 and one middle layer folding 702 is provided at the center of the shopping bag to fold the shopping bag 100 at the center. In an embodiment, the folded sides can be fastened together by using a plurality of buttons and tied together with a bungee band.

In another embodiment, the folded sides can be attached using the hook and loop fastener strips provided at the four corners of the shopping bag 100.

Figure 8:
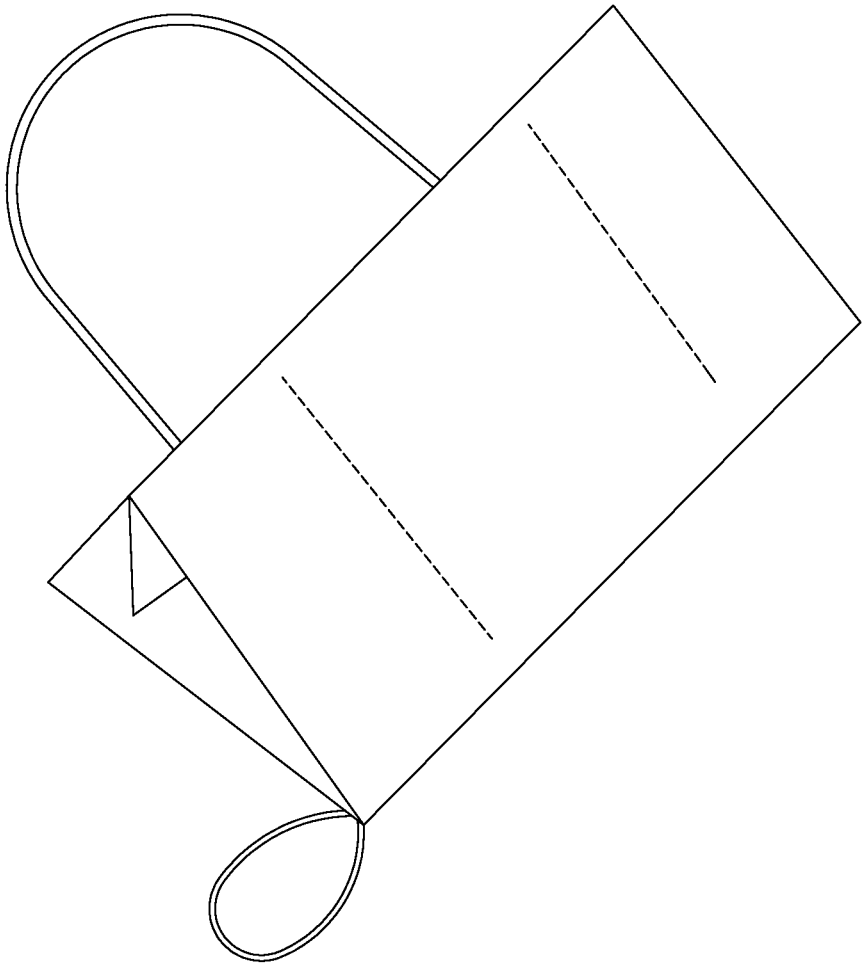
FIG. 8 illustrates the shopping bag folded at the center.

Referring to FIG. 8, illustrates the shopping bag 100 folded at the center of the shopping bag 100. The shopping bag 100 is folded towards the center to reduce the size of the shopping bag 100.

Figure 9:
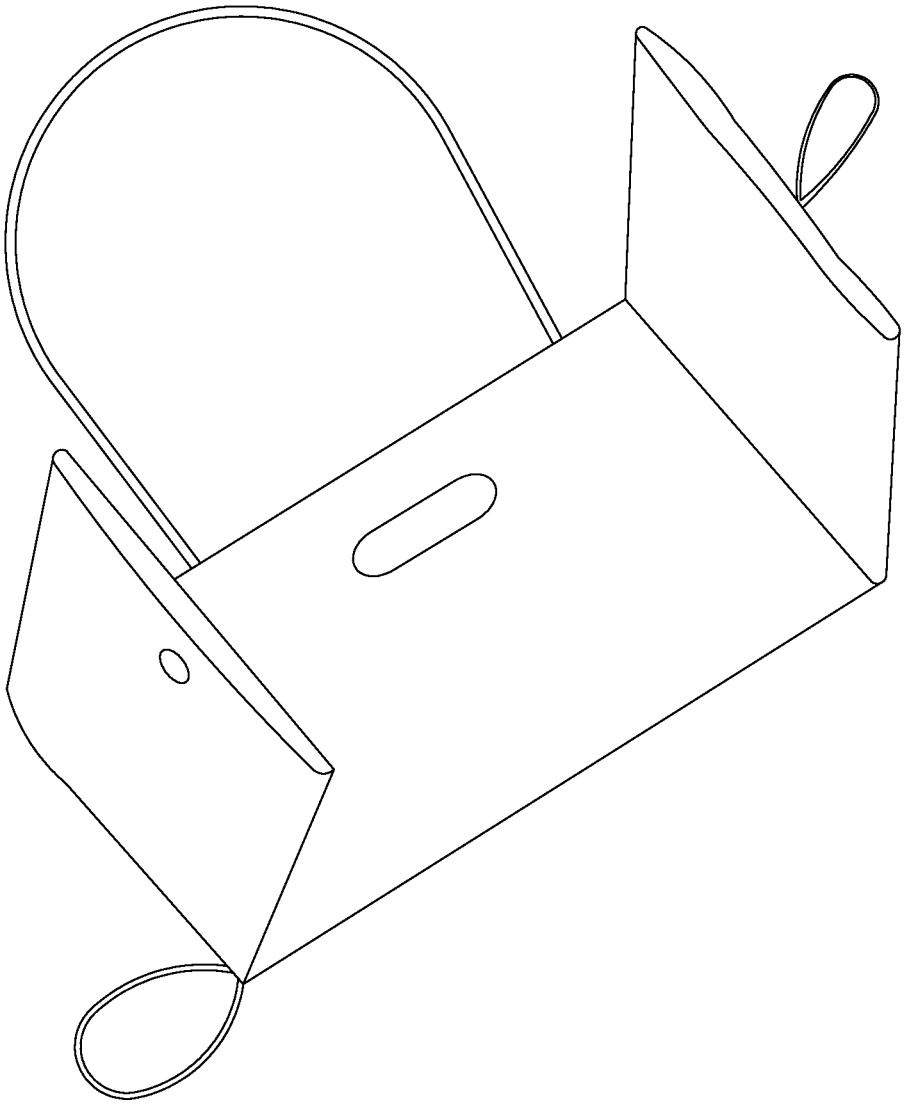
FIG. 9 illustrates the shopping bag folded towards the side portion.

Referring to FIG. 9, illustrates the shopping bag 100 folded towards the side portion of the shopping bag 100. The shopping bag 100 is folded at the sides and enclosed at the front portion of the shopping bag 100. In an embodiment, the folded sides of the shopping bag 100 can be fastened by using a plurality of buttons provided at the folded sides and tied together by using a bungee band.

Figure 10:
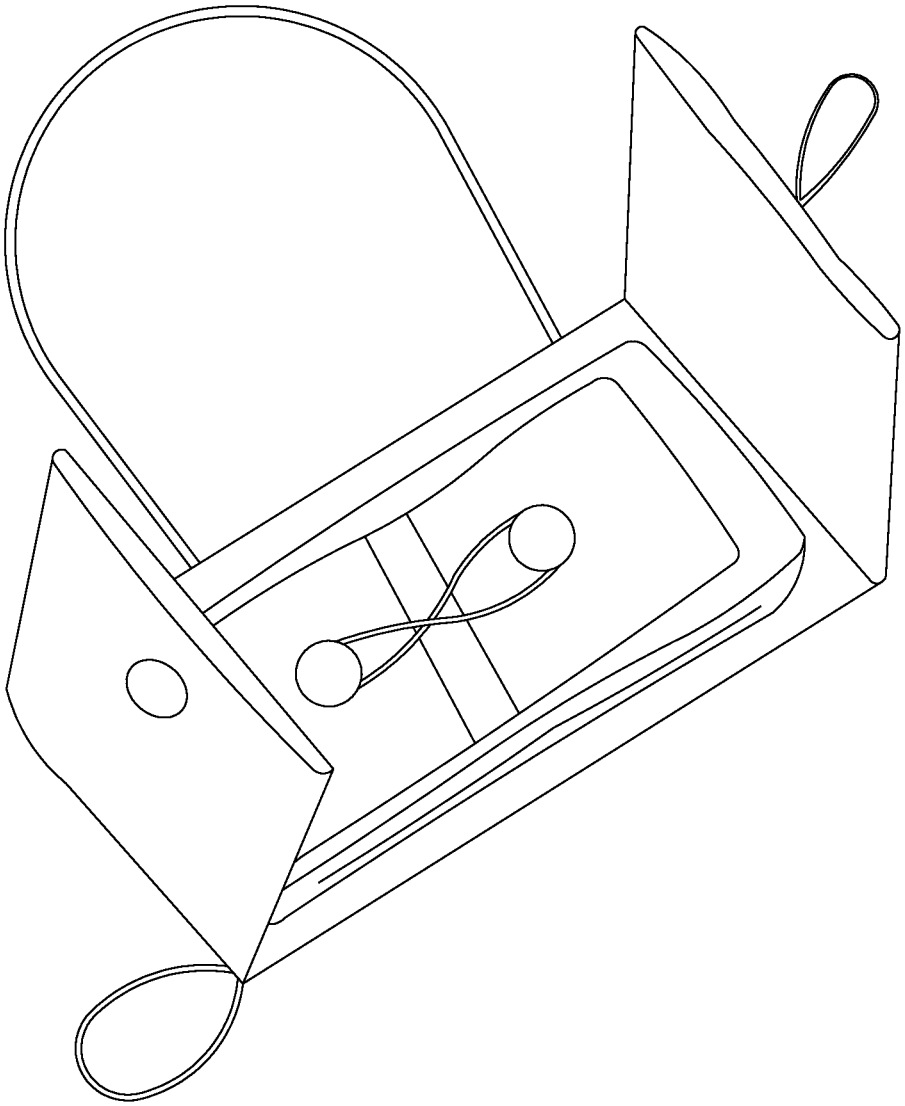
FIG. 10 illustrates the shopping bag folded towards the side portion and attached with a detachable wristlet pouch.

Referring to FIG. 10, illustrates the shopping bag 100 folded towards the side portion of the shopping bag 100 attached with the detachable wristlet pouch. The shopping bag 100 is attached with a wristlet pouch 102 in the front portion and the side portions of the shopping bag 100 are folded towards the front portion.

Figure 11:
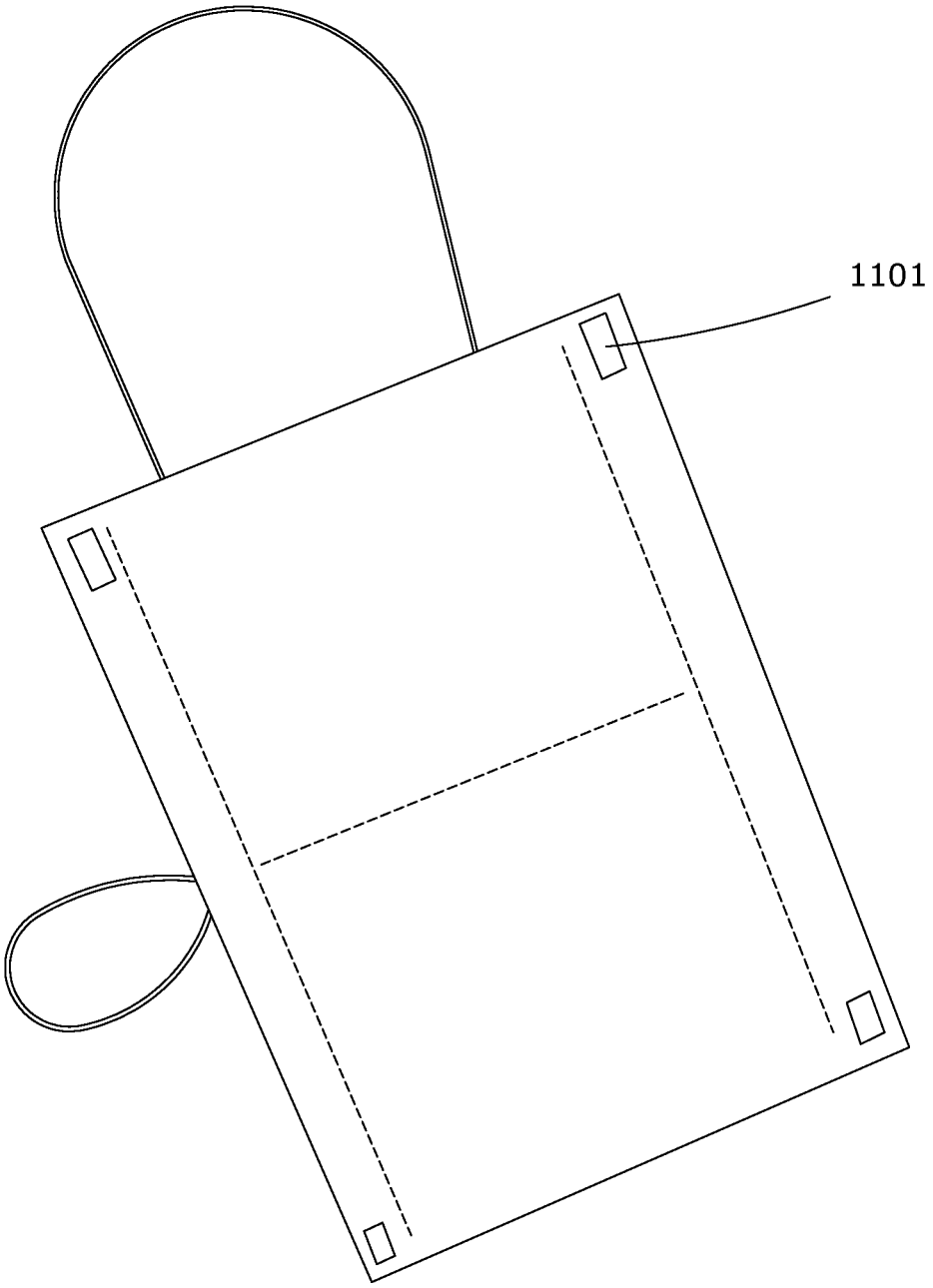
FIG. 11 illustrates the shopping bag provided with hook and loop fastener strips at the four corners of the shopping bag.

Referring to FIG. 11, illustrates the shopping bag 100 provided with hook and loop fastener strips 1101 at the four corners of the shopping bag 100. The hook and loop fastener strips 1101 provided at the four corners of the shopping bag 100 can be used to fold the bag towards the center or at the sides of the bag and fixed by using the hook and loop fastener strips 1101 that are provided at the four corners of the shopping bag 100.

Figure 12A:
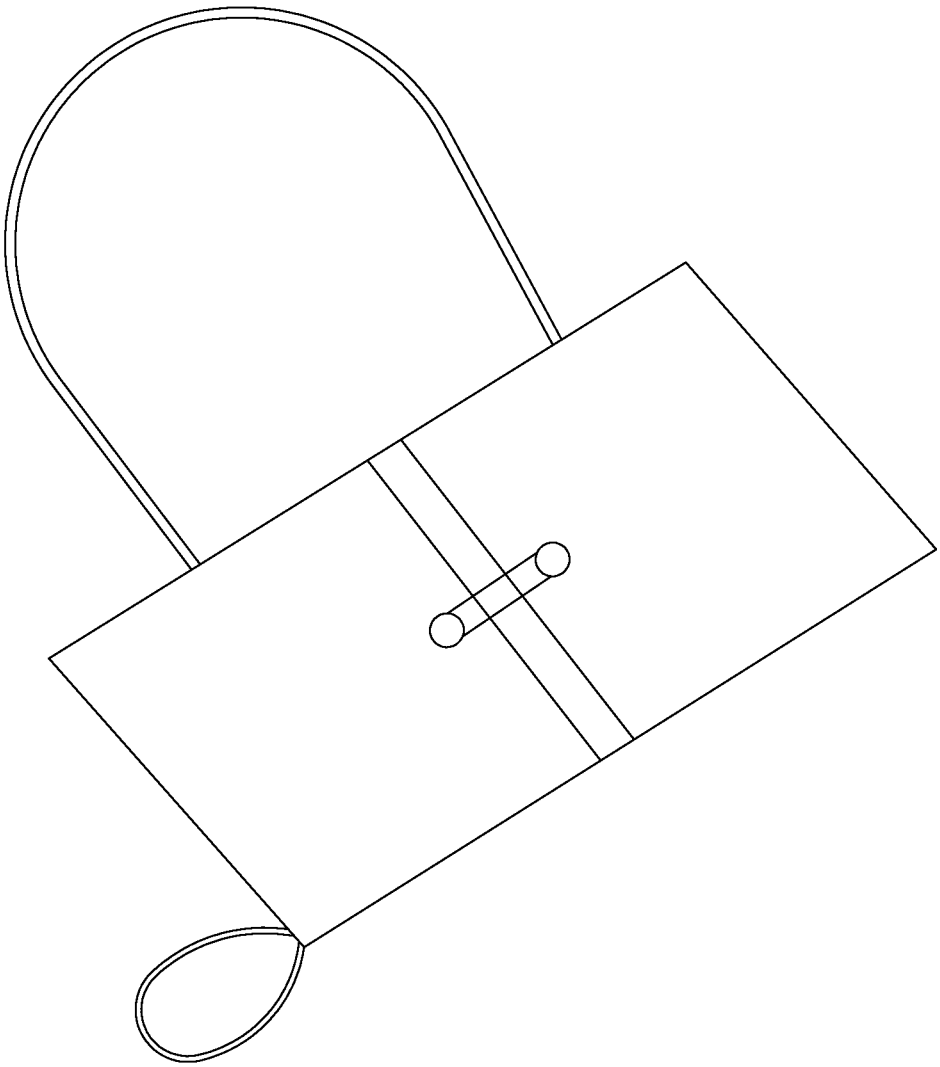
FIGS. 12*a*, 12*b* illustrate a front view and back view of the wristlet pouch that is folded.
Figure 12B:
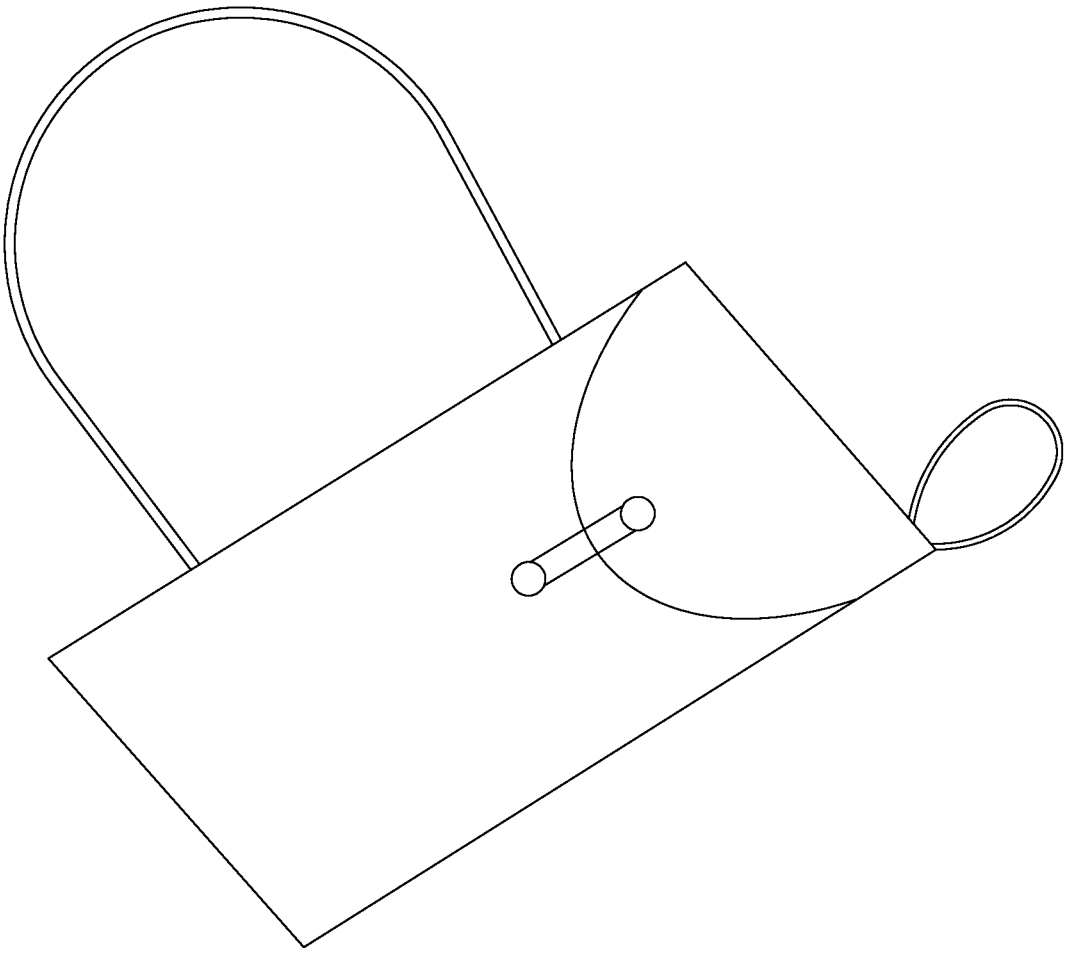

Referring to FIGS. 12*a* and 12*b*, illustrate a front view and back view of the wristlet pouch 102. As depicted in FIG. 12*a*, the wristlet pouch 102 comprises of a handle and a pouch bag 1201 that is enclosed in the front using a plurality of buttons and a bungee band. In an embodiment, the wristlet pouch bag 102 size can be altered by folding the wristlet pouch 102 to the required size. Generally, the size of the wristlet pouch 102 can be approximately 10 by 1 by 6 that can accommodate the largest coupon or other retailer coupons. In an embodiment, the wristlet pouch 102 can be designed with various colors and sizes and may be attached with wheels and/or a fold-up mechanism to fold the pouch 102 to the required size. As depicted in FIG. 12*b*, the wristlet pouch 102 can be folded towards the back of the pouch 102 and the folded sides of pouch 102 are fastened using the plurality of buttons and the bungee band.

Figure 13A:
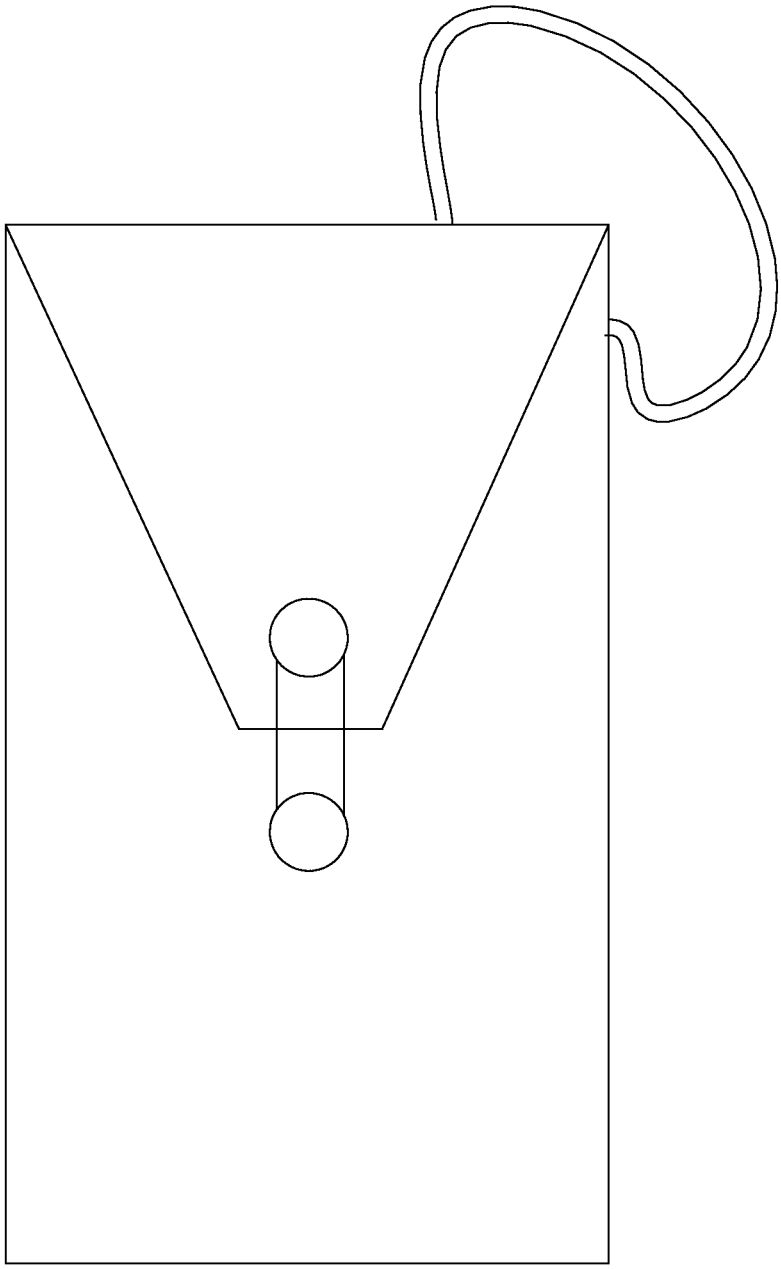
FIGS. 13*a*, 13*b* illustrate a front view and back view of the wristlet pouch.
Figure 13B:
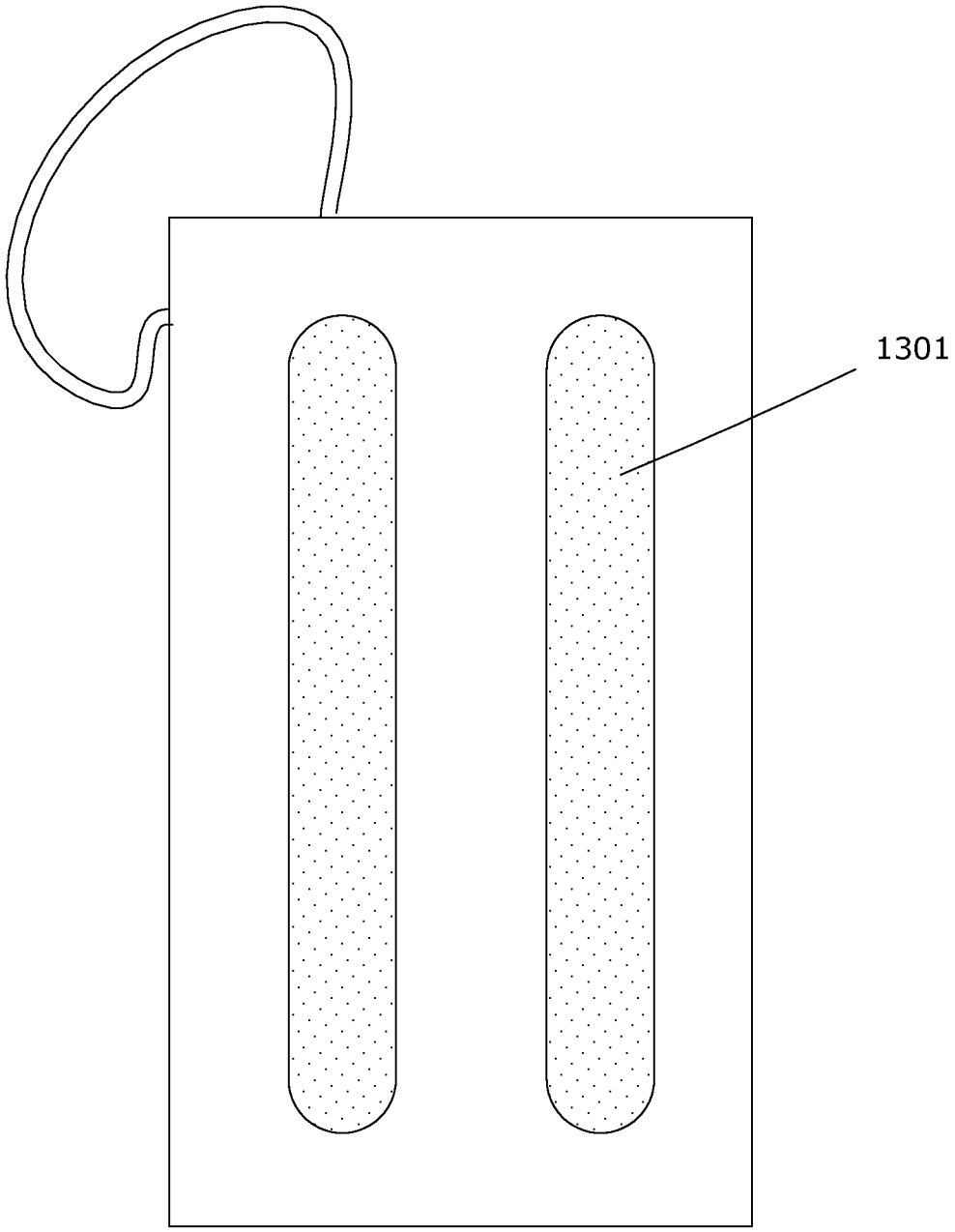

Referring to FIGS. 13*a* and 13*b*, illustrate a front view and back view of the wristlet pouch 102. As depicted in FIG. 13*a*, the front view of the wristlet pouch 102 is enclosed using a plurality of buttons that is fastened together with a bungee band. As depicted in FIG. 13*b*, the back view of the wristlet pouch 102 is fitted with a plurality of hook and loop fastener strips 1301 for attaching the wristlet pouch 102 to the shopping bag 100.

Figure 14:
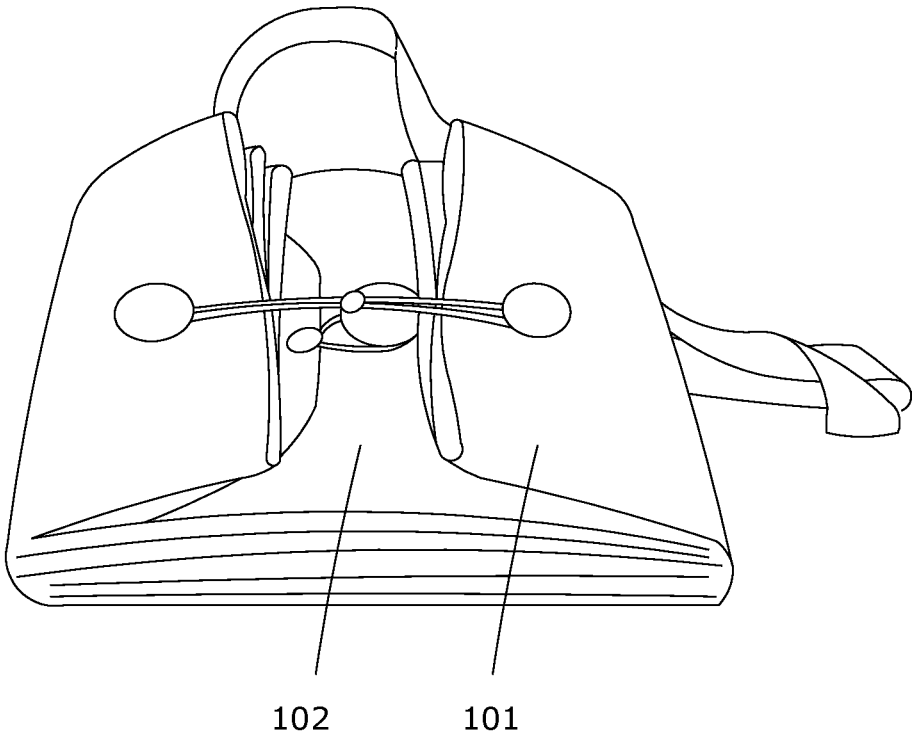
FIG. 14 illustrates a wristlet pouch nested within the main body of the shopping bag.

Referring to FIG. 14, illustrates a wristlet pouch bag 102 nested within the main body 101 of the shopping bag 100. As depicted in the figure, the wristlet pouch bag 102 is placed in the front portion of the shopping bag 100, wherein the shopping bag 100 is folded to the size of the wristlet pouch bag 102 and allows the customer to carry the handle attached to the wristlet pouch bag 102 to provide a hands free shopping experience to the customer while involved in a shopping activity. In an embodiment, the main body 101 of the shopping bag 100 is folded in the center along the middle fold 702 and further folded along the vertical folds 703 after placing the wristlet pouch 102 in the front portion of the main body 101. The wristlet pouch 102 is attached to the front portion of the main body 101 by using a plurality of hook and loop fastener strips 1301 that is provided at the back of the wristlet pouch 102. After placing the wristlet pouch 102 in the front portion of the main body 101, the vertical folds of the main body 101 are fastened together by connecting the plurality of buttons 201 with the bungee band 202.

Figure 15:
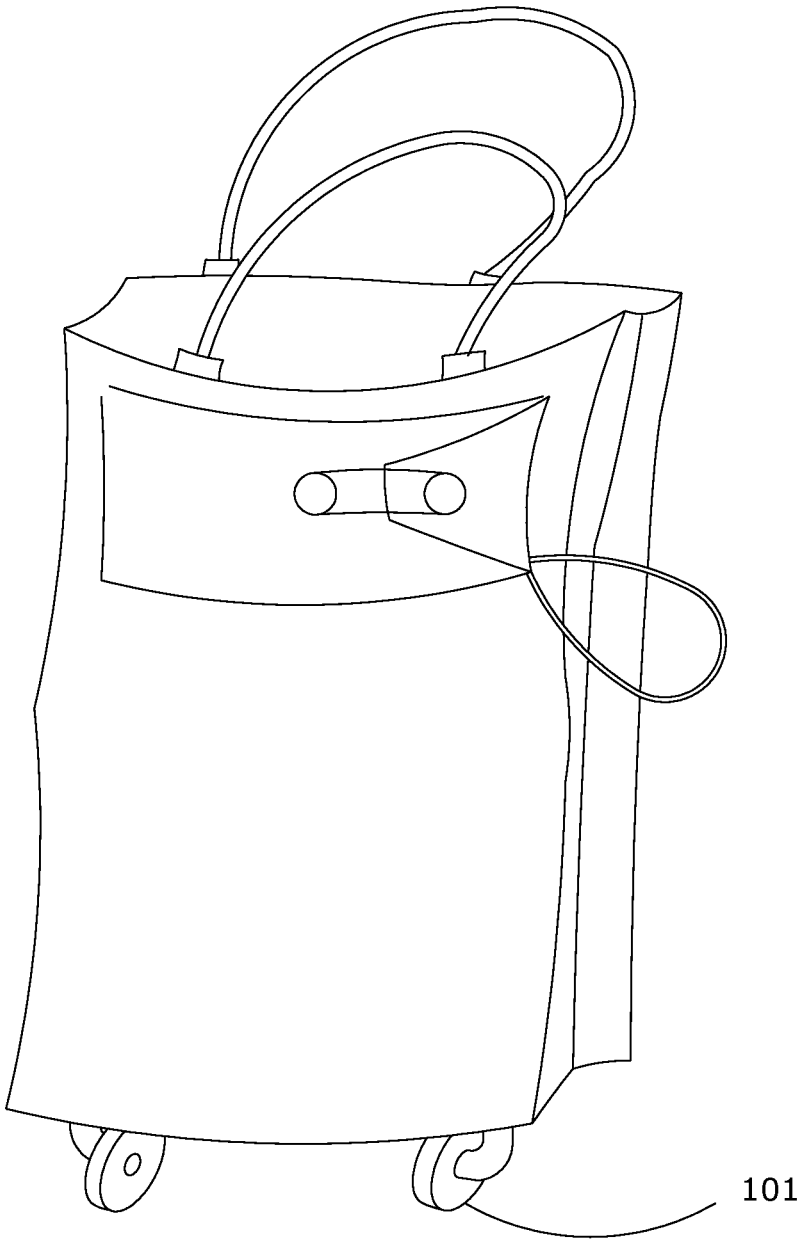
FIG. 15 illustrates a plurality of wheels attached to the shopping bag.
Figure 16:
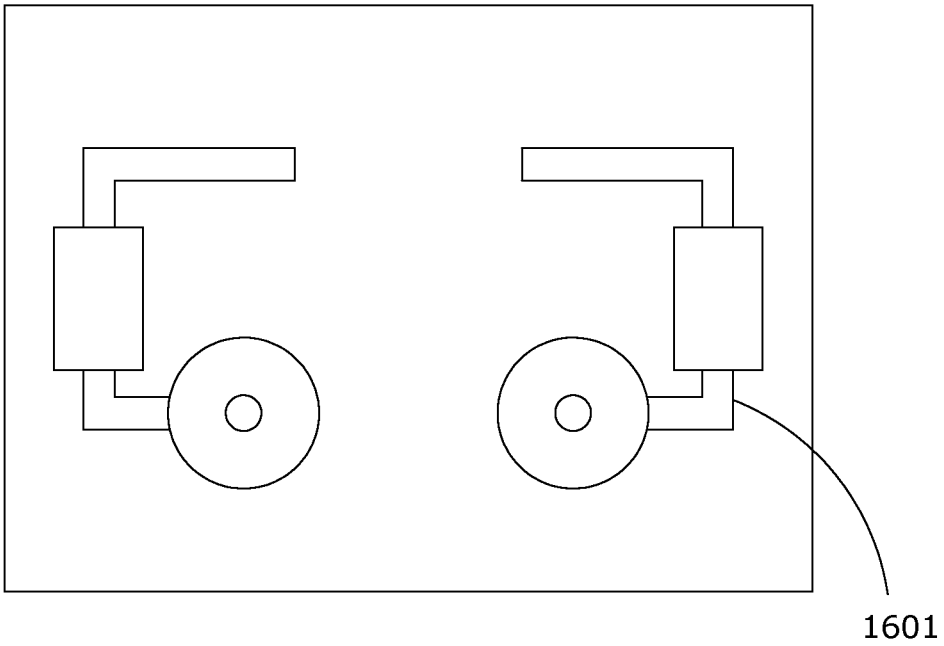
FIG. 16 illustrates a retractable plurality of wheels attached to the shopping bag.

Referring to FIGS. 15 and 16, illustrate a plurality of retractable wheels 1501 attached to the shopping bag 100. In an embodiment, the plurality of retractable wheels 1501 attached to the shopping bag 100 allows the shopping bag 100 to move up and down. As depicted in the FIG. 16, the retractable wheels 1601 are retracted downwards.

The invention claimed is:

1. A shopping bag that is designed to enhance a consumer's experience while shopping, the shopping bag comprises:

a main body with a first handle attached to a first side of the main body and a second handle attached to a second side of the main body;

a center fold provided at a middle of the main body for folding the main body towards the center;

a first vertical fold, parallel to the center fold and located between the center fold and the first side of the main body;

a second vertical fold, parallel to the center fold and located between the center fold and the second side of the main body;

a first plurality of snap buttons located proximate the first side on a bottom of the main body;

a second plurality of snap buttons located between the center fold and the first side on a bottom of the main body; wherein the second plurality of snap buttons are adapted to mate with the first plurality of snap buttons;

a third plurality of snap buttons located proximate the second side on a bottom of the main body;

a fourth plurality of snap buttons located between the center fold and the second side on a bottom of the main body; wherein the fourth plurality of snap buttons are adapted to mate with the third plurality of snap buttons.

2. The shopping bag of claim 1, further comprising a wristlet pouch attached to the first side.

3. The shopping bag of claim 2, wherein the wristlet pouch further comprises a front side joined to a back side and an opening flap.

4. The shopping bag of claim 3, wherein the wristlet pouch further comprises a bungee band, connecting the opening flap to the front side.

5. The shopping bag of claim 1, further comprising a bottom flap, joined to the first side and the second side at a bottom of the shopping bag.

6. The shopping bag of claim 5, further comprising a middle layer folding located at a center of the shopping bag on the first side and parallel to the first plurality of snap buttons.

7. The shopping bag of claim 6, a first vertical folding and a second vertical folding located on the first side and perpendicular to the middle layer folding.

* * * * *